United States Patent [19]

Kobayashi et al.

[11] Patent Number: 4,874,295

[45] Date of Patent: Oct. 17, 1989

[54] SLANT PLATE TYPE COMPRESSOR WITH VARIABLE DISPLACEMENT MECHANISM

[75] Inventors: Hideto Kobayashi; Kiyoshi Terauchi, both of Gunma, Japan

[73] Assignee: Sanden Corporation, Gunma, Japan

[21] Appl. No.: 172,452

[22] Filed: Mar. 24, 1988

[30] Foreign Application Priority Data

Mar. 24, 1987 [JP] Japan ..... 62-42002[U]

[51] Int. Cl.[4] ..... F04B 1/26

[52] U.S. Cl. ..... 417/222; 417/270

[58] Field of Search ..... 417/222 S, 269, 270

[56] References Cited

U.S. PATENT DOCUMENTS

| | | | |
|---|---|---|---|
| 4,037,993 | 7/1977 | Roberts . | |
| 4,073,603 | 2/1978 | Abendschein et al. . | |
| 4,145,163 | 3/1979 | Fogelberg et al. . | |
| 4,428,718 | 1/1984 | Skinner . | |
| 4,475,871 | 10/1984 | Roberts . | |
| 4,480,964 | 11/1984 | Skinner . | |
| 4,492,527 | 1/1985 | Swain | 417/222 S |
| 4,526,516 | 7/1985 | Swain et al. . | |
| 4,533,299 | 8/1985 | Swain et al. . | |
| 4,543,043 | 9/1985 | Roberts . | |
| 4,586,874 | 5/1986 | Hiraga et al. . | |
| 4,606,705 | 8/1986 | Parekh . | |
| 4,632,640 | 12/1986 | Terauchi . | |
| 4,664,604 | 5/1987 | Terauchi . | |
| 4,685,866 | 8/1987 | Takewara | 417/222 S |
| 4,687,419 | 8/1987 | Suzuki et al. . | |
| 4,688,997 | 8/1987 | Suzuki et al. . | |
| 4,702,677 | 10/1987 | Takenaka et al. . | |
| 4,729,718 | 3/1988 | Ohta et al. . | |
| 4,778,348 | 10/1988 | Kikuchi et al. . | |
| 4,780,059 | 10/1988 | Taguchi . | |
| 4,780,060 | 10/1988 | Terauchi . | |

FOREIGN PATENT DOCUMENTS

| | | |
|---|---|---|
| 0190013 | 8/1986 | European Pat. Off. . |
| 0219283 | 4/1987 | European Pat. Off. . |
| 3545581 | 7/1986 | Fed. Rep. of Germany . |
| 58-158382 | 9/1983 | Japan . |
| 61-55380 | 7/1986 | Japan . |
| 61-145379 | 7/1986 | Japan . |
| 2155116A | 9/1985 | United Kingdom . |

*Primary Examiner*—William L. Freeh

*Attorney, Agent, or Firm*—Banner, Birch, McKie & Beckett

[57] ABSTRACT

A reciprocating piston type refrigerant compressor includes a compressor housing having a cylinder block provided with a plurality of cylinders and a crank chamber adjacent the cylinder block. A piston slides within each cylinder and is reciprocated by a wobble plate driven by a cam rotor mounted on a drive shaft. The cam rotor includes an adjustable slant angle in close proximity to the wobble plate. Accordingly, the stroke of the pistons within the cylinders can be changed by adjusting the slant angle of the sloping surface. The slant angle of the sloping surface is adjusted in response to the change of pressure in the crank chamber. The crank chamber communicates with the suction chamber through a passageway and a valve control mechanism controls the opening and closing of the passageway. Thus, the capacity of the compressor of can be adjusted by changing the slant angle of the sloping surface of the slant plate in response to the operation of the valve control mechanism.

24 Claims, 7 Drawing Sheets

SLANT PLATE TYPE COMPRESSOR WITH VARIABLE DISPLACEMENT MECHANISM

BACKGROUND OF THE INVENTION

The present invention relates to a refrigerant compressor, and more particularly, to a wobble plate type piston compressor for an air conditioning system in which the compressor includes a mechanism for adjusting the capacity of the compressor.

Generally, in air conditioning apparatus, thermal control is accomplished by intermittent operation of the compressor in response to a signal from a thermostat located in the room being cooled. Once the temperature in the room has been lowered to a desired temperature, the refrigerant capacity of the air conditioning system generally need not be very large in order to handle supplementary cooling due to further temperature changes in the room or for keeping the room at the desired temperature. Accordingly, after the room has cooled down to the desired temperature, the most common technique for controlling the output of the compressor is by intermittent operation of the compressor. However, intermittent operation of the compressor results in intermittent application of a relatively large load to the driving mechanism of the compressor in order to drive the compressor.

In automobile air conditioning compressors, the compressor is driven by the engine of the automobile through an electromagnetic clutch. These automobile air conditioning compressors face the same intermittent load problems described above once the passenger compartment reaches a desired temperature. Control of the compressor normally is accomplished by intermittent operation of the compressor through the electromagnetic clutch which couples the automobile engine to the compressor. Thus, the relatively large load which is required to drive the compressor is intermittently applied to the automobile engine.

Furthermore, since the compressor of an automobile air conditioner is driven by the engine of the automobile, the rotation frequency of the drive mechanism changes from moment to moment, which causes the refrigerant capacity to change in proportion to the rotation frequency of the engine. Since the capacity of the evaporator and condenser of the air conditioner does not change when the compressor is driven at high rotation speed, the compressor performs useless work. To avoid performing useless work, prior art automobile air conditioning compressors often are controlled by intermittent operation of the magnetic clutch. Again, this results in a large load being intermittently applied to the automobile engine.

Recently, it was recognized that it is desirable to provide a wobble plate type piston compressor with a displacement or capacity adjusting mechanism to control the compression ratio in response to demand. In a wobble plate type piston compressor, control of the compression ratio can be accomplished by changing the slant angle of the sloping surface of the slant plate in response to operation of the valve control mechanism as disclosed in U.S. Pat. No. 4,586,874 issued May 6, 1986 to Masaharu Hiraga et al. Referring to FIG. 8, this application discloses a mechanism for controlling the compression ratio of the compressor which includes a passageway 391 formed between suction chamber 35 and crank chamber 13. This passageway 391 is formed by drilling a hole through cylinder block 101 and valve plate 24. The machining operation required to form the passageway 391 adds to the manufacturing cost of the compressor. Furthermore, the formation of passageway 391 through cylinder block 101 tends to decrease the mechanical strength and structural integrity of cylinder block 101. The mechanical strength and structural integrity of the cylinder block in a wobble plate type compressor is of considerable importance due to the high pressures which are present inside the cylinder block during operation of the compressor. Thus, in order to maintain the requisite strength and integrity, the diameter of the cylinder block 101 must be enlarged, further adding to manufacturing cost, weight and overall size of the compressor.

SUMMARY OF THE INVENTION

In order to overcome the above noted deficiencies of wobble plate type compressors known in the prior art, it is a primary object of this invention to provide an improved refrigerant compressor wherein a communicating path is provided between the crank chamber and the suction chamber through the central bore formed in the cylinder block.

It is another object of the present invention to provide an improved wobble type refrigerant compressor which achieves the above objective without the presence of an axially penetrating hole in the cylinder block.

It is another object of this invention to provide a refrigerant compressor wherein the central bore connects a part of the communicating path with a female thread portion for an adjusting screw which adjusts the axial location of the compressor drive shaft.

These and other objects of the present invention are achieved by a refrigerant compressor which includes a housing having a cylinder block with a plurality of cylinders and a crank chamber adjacent the cylinder block. A piston is slidably disposed within each cylinder and is reciprocated by a wobble plate driven by an input cam rotor. The cam rotor is provided with an adjustable slant plate which includes a slopping surface at an adjustable slant angle in close proximity to the wobble plate. A drive shaft is connected to the cam rotor and is rotatably supported by the compressor housing. A front end plate, which rotatably supports the drive shaft through a bearing, is disposed on an opening of the crank chamber. A rear end plate, which is disposed on the opposite end of the housing, includes a suction chamber and a discharge chamber for refrigerant. The rear end plate is fixed on the housing together with a valve plate. A central bore is formed at the center of the cylinder block, wherein the drive shaft is also rotatably supported. An adjusting screw is screwed into the central bore to adjust the axial location of the drive shaft. A portion of a communicating path between the crank chamber and the suction chamber is formed at the central bore. Opening and closing of the communicating path is controlled by a valve control mechanism. The angle of the sloping surface of the slant plate can be changed in response to a change in pressure in the crank chamber. Thus, the stroke of the piston may be controlled to adjust the capacity of the compressor.

Further objects, features and other aspects of this invention will be understood from the following detailed description of the preferred embodiment of this invention with reference to the annexed drawings.

DETAILED DESCRIPTION OF THE PREFERRED EMBODIMENT

Figure 1:
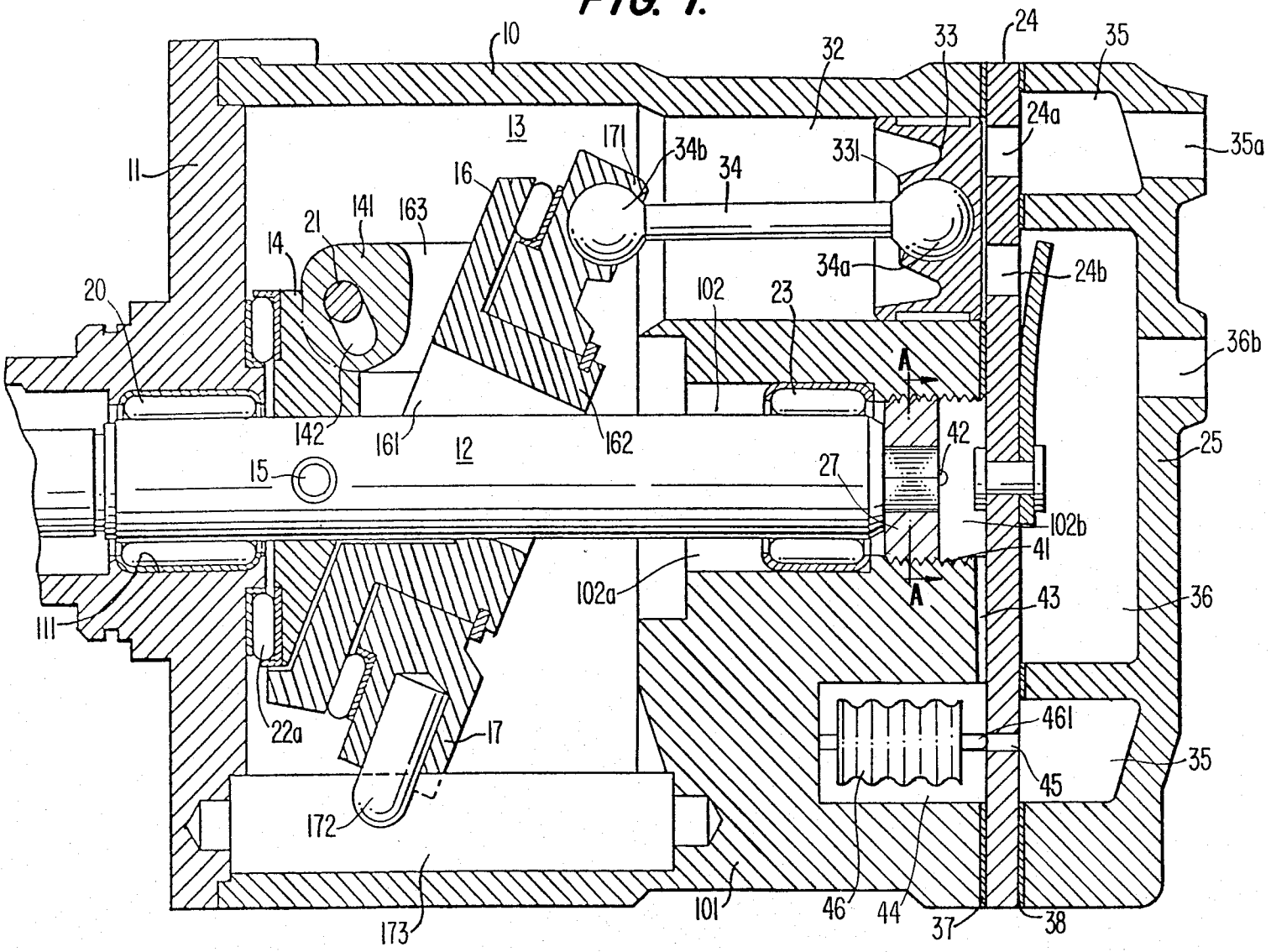
FIG. 1 is a vertical cross-sectional view of a refrigerant compressor according to one embodiment of this invention.

Referring to the FIG. 1, a refrigerant compressor 1 in accordance with one embodiment of the present invention is shown. The compressor 1 includes closed cylindrical housing assembly 10 formed by cylinder block 101, a crank chamber 13 within cylinder block 101, front end plate 11 and read end plate 25.

Front end plate 11 is mounted on the left end portion of crank chamber 13, as shown in FIG. 1, by a plurality of bolts (not shown). Rear end plate 25 and valve plate 24 are mounted on cylinder block 101 by a plurality of bolts (not shown). Opening 111 is formed in front end plate 11 for receiving drive shaft 12.

Drive shaft 12 is rotatably supported by front end plate 11 through bearing 20 which is disposed within opening 111. The inner end portion of drive shaft 12 is also rotatably supported by cylinder block 101 through bearing 23 which is disposed within central bore 102. Central bore 102 is a cavity formed in the center portion of cylinder block 101. Thrust needle bearing 22*a* is disposed between the inner end surface of front end plate 11 and the adjacent axial end surface of cam rotor 14.

Cam motor 14 is fixed on drive shaft 12 by pin member 15 which penetrates cam rotor 14 and drive shaft 12. Cam rotor 14 is provided with arm 141 having slot 142. Slant plate 16 has opening 161 through which passes drive shaft 12. Axial annular projection 162 extends from the circumference of opening 161 in the front end surface of slant plate 16. Slant plate 16 includes arm 163 having pin 21 which is inserted in slot 142. Cam rotor 14 and slant plate 16 are joined by the hinged joint of pin 21 and slot 142. The pin 21 is able to slide within slot 142 so that the angular position of slant plate 16 can be changed with respect to the longitudinal axis of drive shaft 12.

Wobble plate 17 is rotatably mounted on slant plate 16. The rotation of wobble plate 17 is prevented by a fork-shaped slider 172 which is attached to the outer peripheral end of wobble plate 17 and is slidably mounted on sliding rail 173 held between front end plate 11 and cylinder block 101. In order to slide slider 172 on the sliding rail 173, wobble plate 17 wobbles in a non-rotating manner in spite of the rotation of cam rotor 14.

Cylinder block 101 has a plurality of annularly arranged cylinder chambers 32 in which respective pistons 33 slide. All pistons 33 are connected to wobble plate 17 by a corresponding plurality of connecting rods 34. Ball 34*a* at one end of rod 34 is received in socket 331 of pistons 33 and ball 34*b* at the other end of rod 34 is received in socket 171 of wobble plate 17. It should be understood that, although only one such ball socket connection is shown in the drawing, there are a plurality of sockets arranged peripherally around wobble plate 17 to receive the balls of various rods, and that each piston 33 is formed with a socket for receiving the other ball of rods 34.

Rear end plate 25 is shaped to define suction chamber 35 and discharge chamber 36. Valve plate 24, which is fastened to the end of cylinder block 101 by screws (not shown) together with rear end plate 25, is provided with a plurality of valved suction ports 24*a* is connected between suction chamber 35 and the respective cylinders 32, and a plurality of valved discharge ports 24*b* connected between discharge chamber 36 and the respective cylinders 32. Suitable reed valves for suction port 24*a* and discharge port 24*b* are described in U.S. Pat. No. 4,011,029 issued to Shimizu. Gaskets 37, 38 are placed between cylinder block 101 and the inner surface of valve plate 24, and the outer surface of valve plate 24 and rear end plate 25, to seal the mating surfaces of the cylinder block, the valve plate and the rear end plate.

Figure 2:
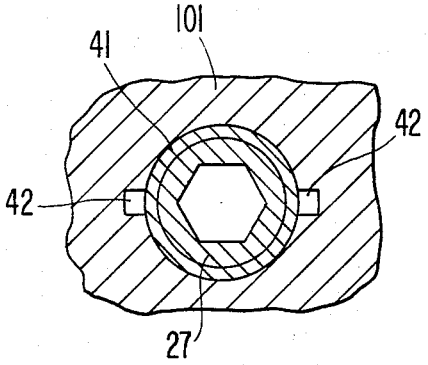
FIG. 2 is a cross-sectional view taken substantially along line A—A of FIG. 1.

Referring to FIG. 2 in addition to FIG. 1, the axial position of drive shaft 12 can be adjusted by adjusting screw 27 into the threaded portion 41 of central bore 102. That is to say, the axial clearance between cam rotor 14 and front end plate 11 through bearing 22*a* can be adjusted by adjusting screw 27. Central bore 102 is partitioned into front chamber 102*a* and rear chamber 102*b* by adjusting screw 27. Front chamber 102*a* communicates with crank chamber 13. A plurality of axial grooves 42 are formed at inner peripheral threaded portion 41 of central bore 102 to communicate between front chamber 102*a* and rear chamber 102*b* of central bore 102.

Groove 43 is formed at the front end surface of cylinder block 101 facing gasket 37. Groove 43 extends radially from rear chamber 102*b* of central bore 102 to pressure sensitive chamber 44 which is formed in the cylinder block 101. Therefore the crank chamber 13 communicates with pressure sensitive chamber 44 through grooves 42 and groove 43. A hole 45 is formed through gasket 37, valve plate 24 and gasket 38 to connect pressure sensitive chamber 44 and suction chamber 35. Bellows valve device 46 is fixed to one surface of pressure sensitive chamber 44 with valve 461 arranged to close off hole 45 in response to the pressure within pressure sensitive chamber 44. The operation of bellows valve device is as follows: The pressure within crank chamber 13 is communicated to pressure sensitive chamber 44 through grooves 42 and 43. Thus, the pressure within pressure sensitive chamber 44 is the same as the pressure within crank chamber 13. When the pressure within crank chamber 13 and pressure sensitive chamber 44 are below a predetermined pressure, the bellows of the bellows valve device 46 expands causing valve 461 to close hole 45. Therefore when the compressor is not being driven, the pressure within crank chamber 13 is balanced pressure, valve 461 of the bellows valve device 46 closes the hole 45. When the pressure within crank chamber 13 and pressure sensitive chamber 44 is above a predetermined pressure, the bellows of bellows valve device 46 is compressed causing valve 461 to open hole 45.

In operation of the compressor, drive shaft 12 is rotated by the engine of the vehicle through an electromagnetic clutch. Cam rotor 14 is rotated together with drive shaft 12 to cause a non-rotating wobbling motion of wobble plate 17. Rotating motion of wobble plate 17 is prevented by fork-shape slider 172 which is attached to the outer peripheral end of wobble plate 17 and is slidably mounted on sliding rail 173 held between front end plate 11 and cylinder block 101. As wobble plate 17 moves, pistons 33 reciprocates out of phase in their respective cylinders 32. Upon reciprocation of pistons 33, the refrigerant gas, which is introduced into suction chamber 35 from a fluid inlet port 35*a*, is taken into each cylinder 32 and compressed. The compressed refrigerant is discharged to discharge chamber 36 from each cylinder 32 through discharge port 24*b*, and therefrom into an external fluid circuit, for example, a cooling circuit, through a fluid outlet port 36*b*.

At the beginning of compressor operation, hole 45 is closed by valve 461 of the bellows valve device 46 because the pressure within crank chamber 13 is low. As the compressor operates, the pressure within crank chamber 13 gradually rises to create a small pressure difference between crank chamber 13 and suction chamber 35. This pressure difference occurs because blow-by-gas, which leaks from the cylinder chambers to crank chamber 13 through a gap between the pistons 33 and cylinders 32 during the compression stroke, is contained in crank chamber 13. The movement of pistons 33 is hindered by the pressure difference between crank chamber 13 and suction chamber 35, i.e., as the pressure in the crank chamber approaches the mid-pressure of the compressed gas in the cylinder chambers during the suction stroke, movement of the pistons is hindered because the slant angle of slant plate 16 gradually decreases until it approaches zero, i.e., slant plate 16 would be perpendicular to the drive shaft 12. As the slant angle of slant plate 16 decreases, the stroke of pistons 33 in the cylinders 32 is reduced and the capacity of the compressor gradually decreases.

When the pressure of crank chamber 13 and pressure sensitive chamber 44 rises over the predetermined pressure, the bellows of bellows valve device 46 is sufficiently compressed and valve 461 of bellows valve device 46 opens hole 45. Simultaneously, crank chamber 13 communicates with suction chamber 35 through central bore 20 via grooves 42 and groove 43 formed at the front end surface of cylinder block 101, pressure sensitive chamber 44 and hole 45. Accordingly, the pressure of crank chamber 13 falls to the pressure of suction chamber 35. In this condition, wobble plate 17 usually is urged toward slant plate 16 during the compression stroke of the pistons 33 so that slant plate 16 moves toward rotor 14. Thus, the slant angle of slant plate 16 is maximized relative to a vertical plane through the hinged joint of pin 21 and slot 142. This results in the maximum stroke of pistons 33 within cylinders 32 which corresponds to the normal refrigerant capacity of the compressor. However, the falling pressure of crank chamber 13 causes valve 461 of bellows valve device to close hole 45. Thus the compressor is placed in a reduced compression stage again. Thus, in accordance with the above mentioned states, full and reduced displacement of compressor is achieved.

Figure 3:
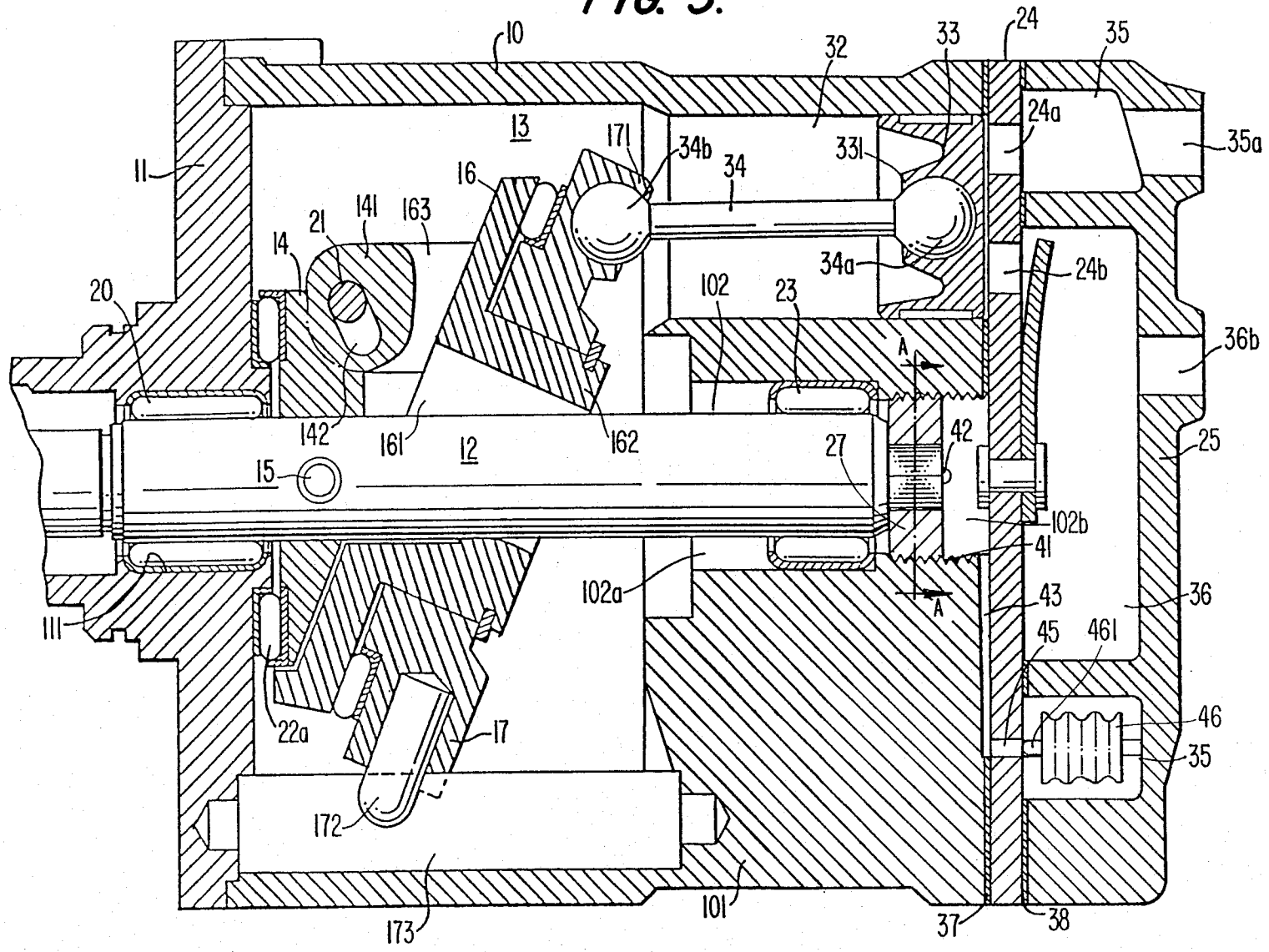
FIG. 3 is a vertical cross-sectional view of a refrigerant compressor according to a second embodiment of this invention.

In this embodiment, the bellows valve device 46 is disposed in pressure sensitive chamber 44 formed in the cylinder block 101. Bellows valve device 46 also may be disposed in suction chamber 35 as shown in FIG. 3. In the embodiment shown in FIG. 3, the opening and closing of hole 45 are accordingly controlled by the change of pressure in suction chamber 35.

Figure 4:
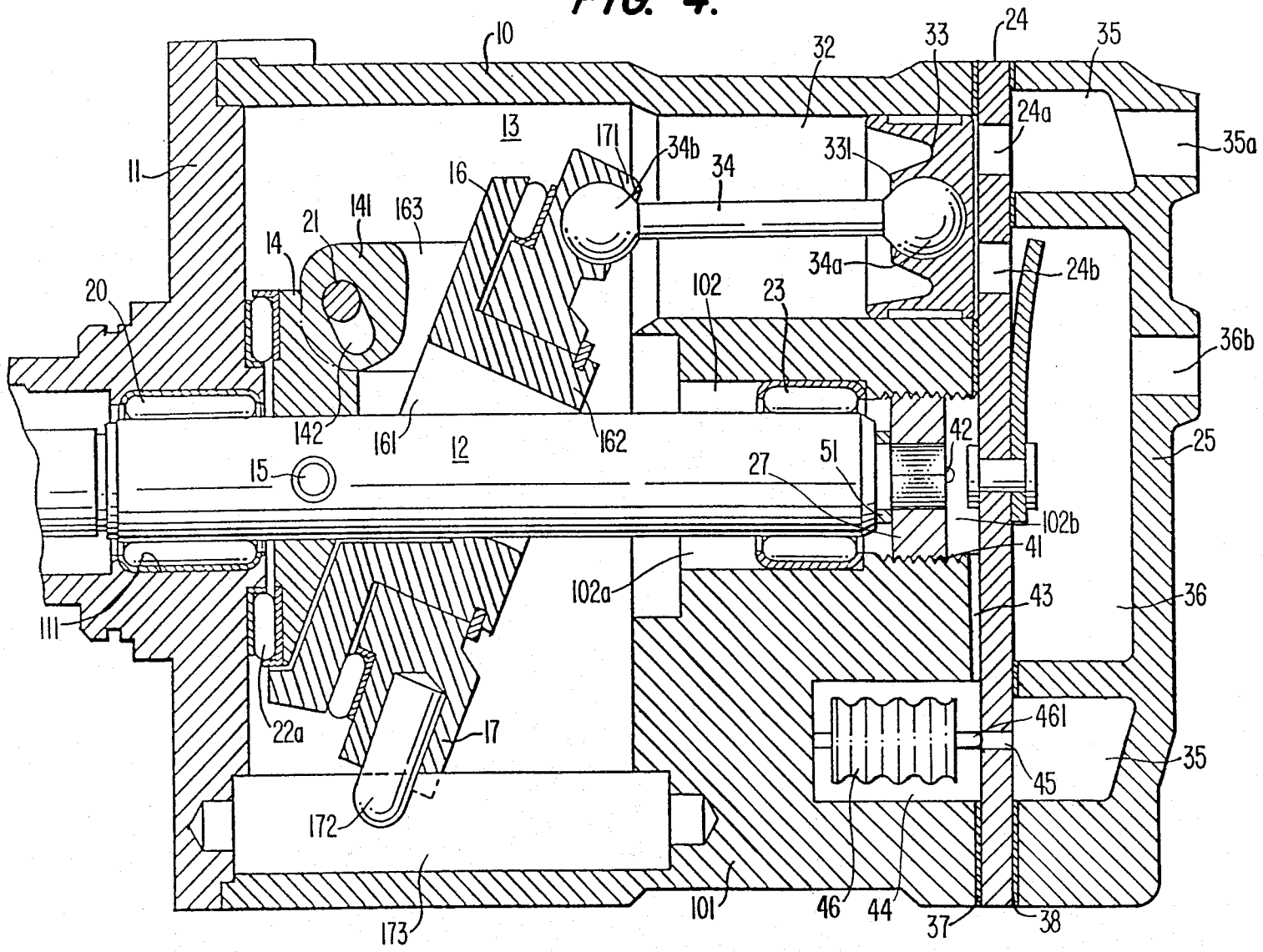
FIG. 4 is a vertical cross-sectional view of a refrigerant compressor according to a third embodiment of this invention.
Figure 5:
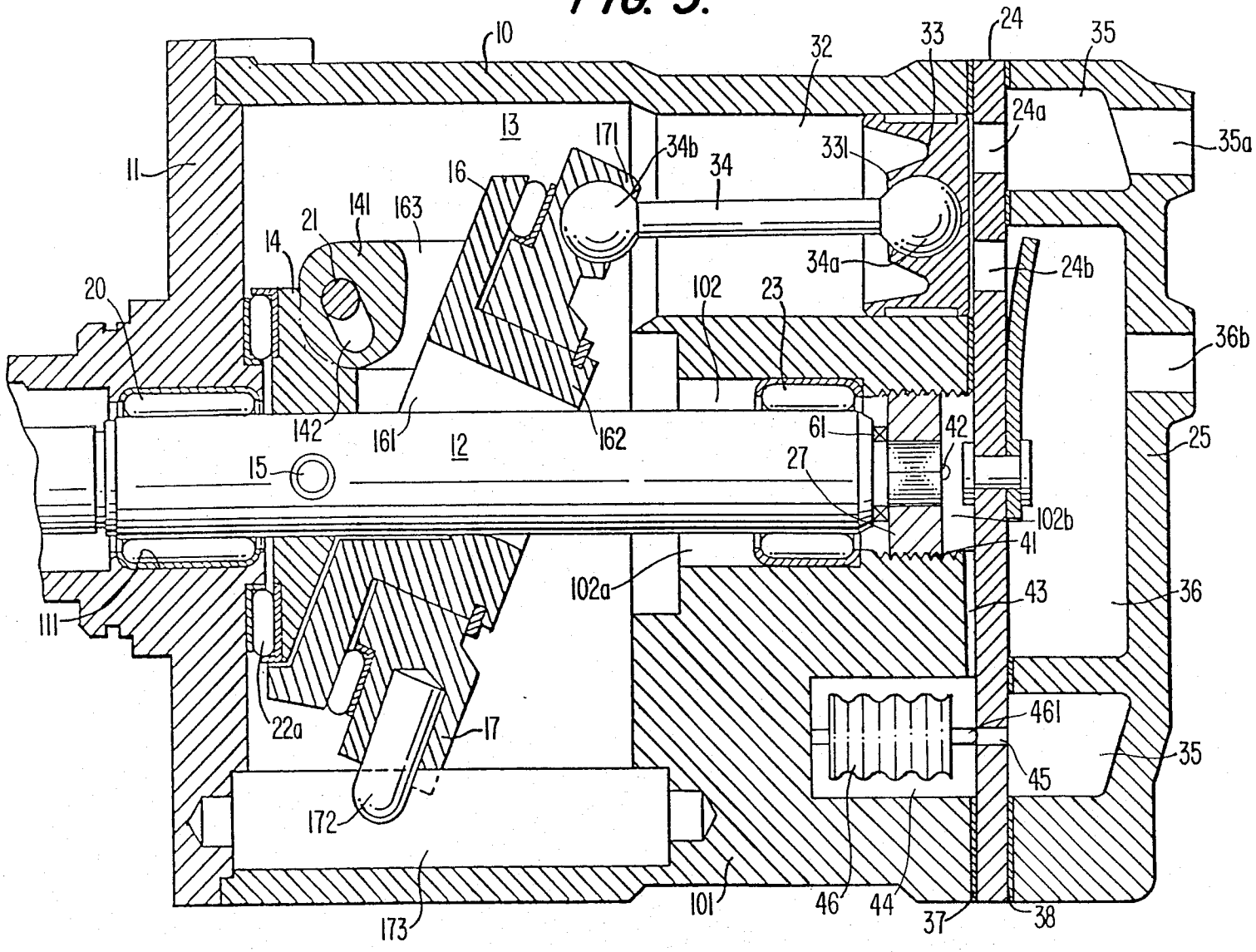
FIG. 5 is a vertical cross-sectional view of a refrigerant compressor according to a fourth embodiment of this invention.

Referring to FIG. 4, a refrigerant compressor 1 in accordance with another embodiment of the present invention is shown. In this embodiment, an annular shim 51 is disposed between adjusting screw 27 screwed into the threaded portion 41 of central bore 102 and the inner end of the drive shaft 12. Shim 51 prevents friction which would otherwise occur by the contact of rotating drive shaft 12 with adjusting screw 27. An annular thrust bearing 61 may also be used in place of shim 51 as shown in FIG. 5.

Figure 6:
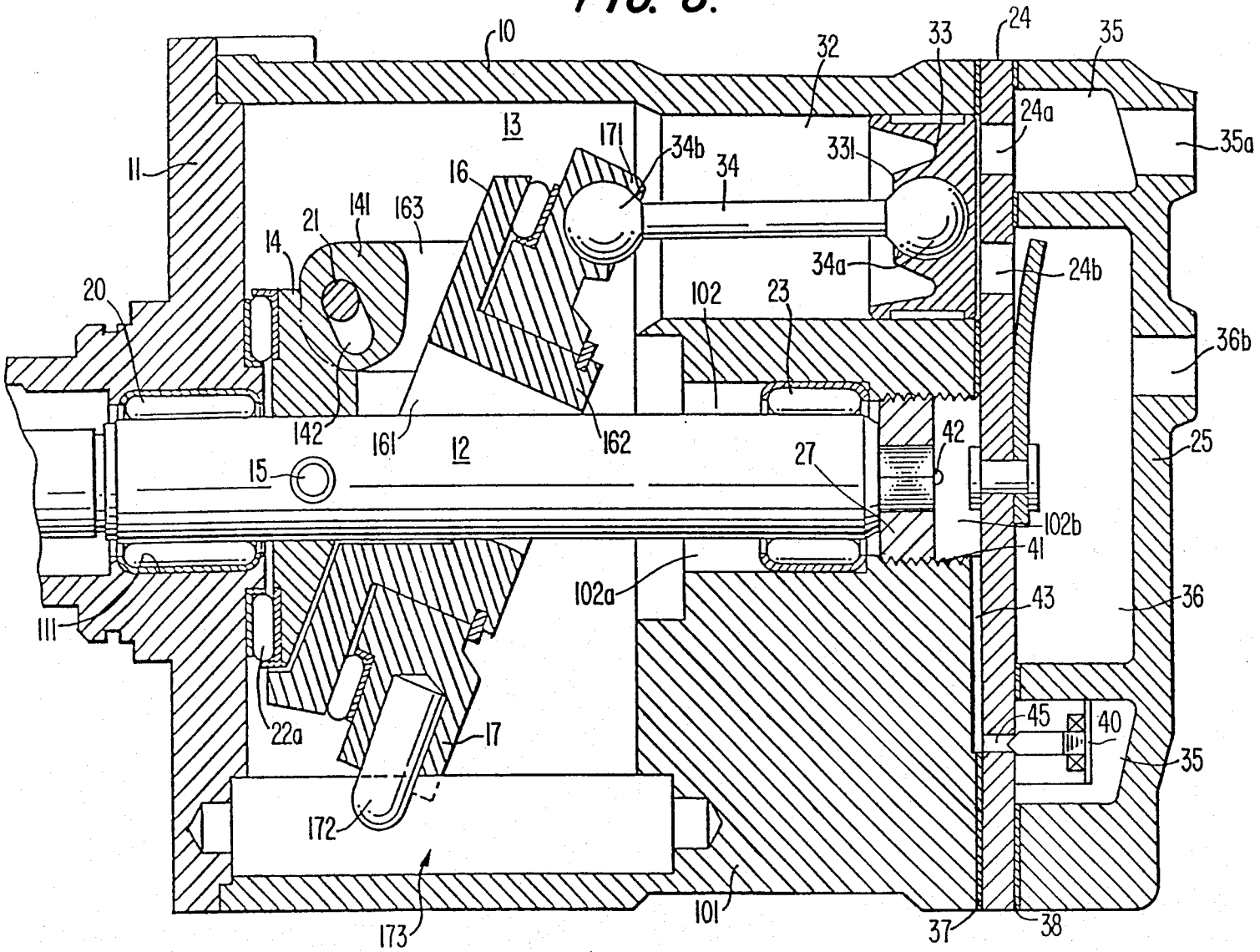
FIG. 6 is a vertical cross-sectional view of a refrigerant compressor according to a fifth embodiment of this invention.
Figure 8:
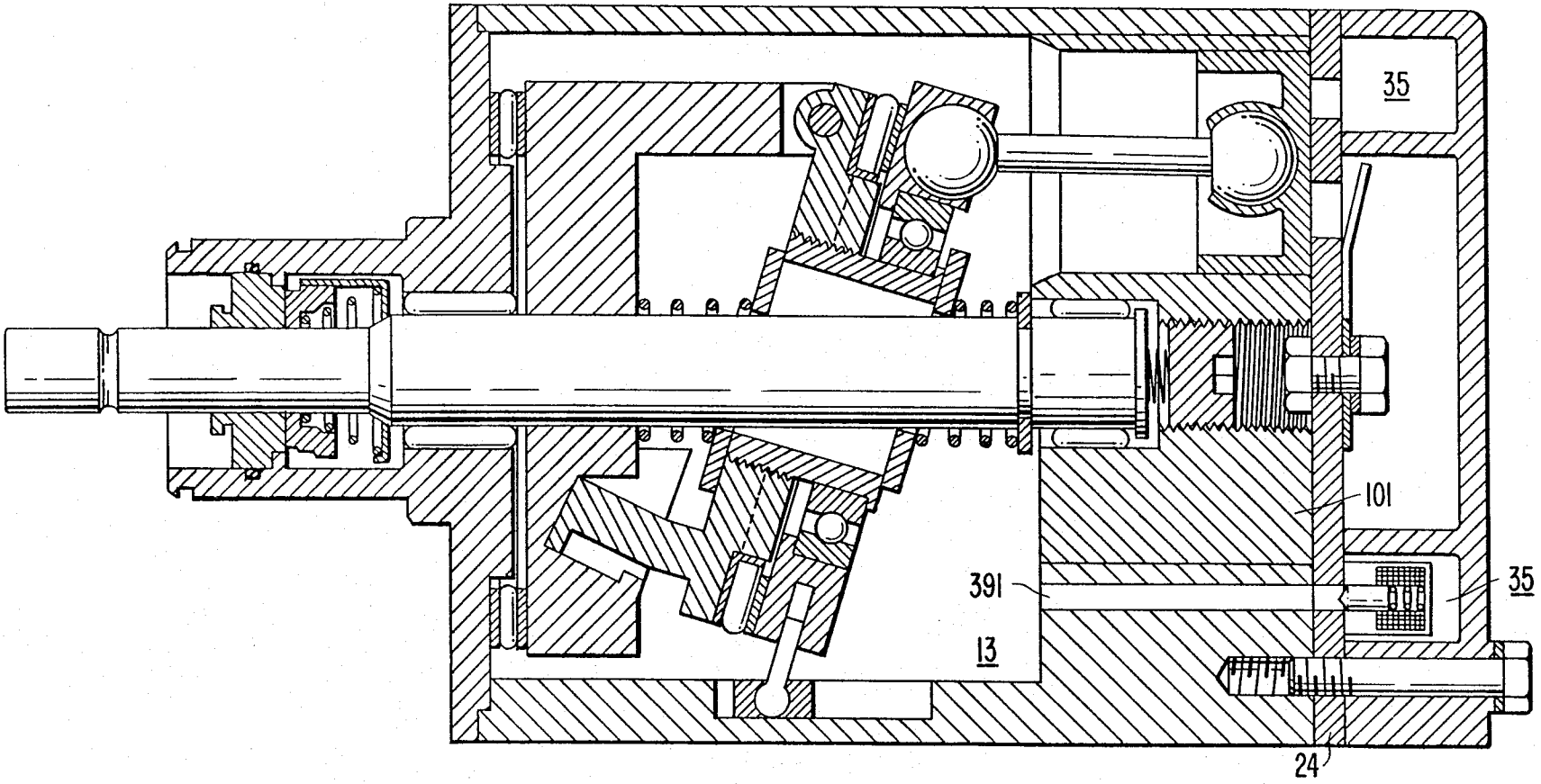
FIG. 8 is a vertical cross-sectional view of a prior art refrigerant compressor.

Referring to FIG. 6, a refrigerant compressor 1 is shown in accordance with a further embodiment of the present invention. In this embodiment, electromagnetic valve 40 is disposed in suction chamber 35 in place of bellows valve device 46 which is shown in FIG. 3.

Figure 7:
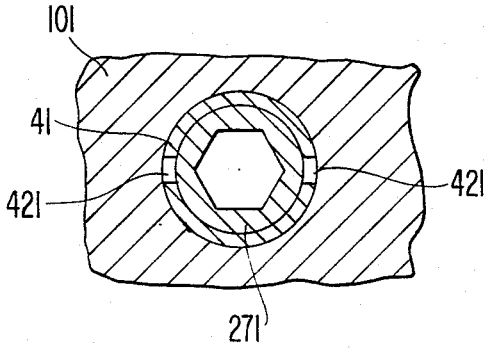
FIG. 7 is a cross-section view taken along line A—A of FIG. 1 according to a sixth embodiment of this invention.

Referring to FIG. 7, and adjusting screw 271 is shown in accordance with another embodiment of the present invention. In this embodiment, a plurality of axial grooves 421 are formed at an outer peripheral surface of adjusting screw 271 to communicate the front chamber 102*a* and rear chamber 102*b* of central bore 102.

The present invention has been described in accordance with preferred embodiments. These embodiments, however, are merely for example only, and the invention should not be construed as limited thereto. It should be apparent to those skilled in the art that other variations or modifications can be made within the scope of this invention.

We claim:

1. In a compressor including a compressor housing, said compressor housing including a cylinder block, front end plate disposed on one end of said cylinder block, a rear end plate disposed on an opposite end of said cylinder block, said rear end plate having a discharge chamber and a suction chamber formed therein, said cylinder block having a plurality of cylinders formed therein, a crank chamber disposed forward of said plurality of cylinders and enclosed within said cylinder block by said front end plate, a piston slidably fitted within each of said cylinders and reciprocated by a drive mechanism, said drive mechanism including a drive shaft extending through an opening in said front end plate and rotatably supported therein, a drive rotor fixedly attached to and rotatable with said drive shaft, a slant plate attached to said drive rotor and disposed around said drive shaft, said slant plate having a surface disposed at an inclined angle with respect to a plane perpendicular to the longitudinal axis of said drive shaft, said inclined angle adjustable with respect to said plane, and a wobble plate disposed on said slant plate and linked to said pistons to reciprocate said pistons in said cylinders, said cylinder block further comprising a central bore having an axially positionable adjusting screw disposed therein, said adjusting screw dividing said central bore into a front chamber and a rear chamber, said drive shaft extending into said central bore, the axial position of said drive shaft adjustable by said adjusting screw, a communicating path linking said crank chamber to said suction chamber, a valve control means for controlling the opening and closing of said communicating path, the inclined angle of said slant plate changing in response to a change of pressure in said crank chamber, the change in pressure in said crank chamber controlled by the opening and closing of said communicating path by said valve control means, the improvement comprising:

said communicating path including at least one groove formed within said central bore, and linking said front chamber of said central bore to said rear chamber of said central bore, said front chamber also linked to said crank chamber; and a further groove formed between a rearward surface of said cylinder block and said rear end plate, said further groove linked in fluid communication at one end with said rear chamber, said further linked in fluid communication at an opposite end with said suction chamber, said communicating path thereby linking said crank chamber to said suction chamber.

2. The compressor recited in claim 1 further comprising a valve plate disposed between said rear end plate and said cylinder block, said valve plate including a hole formed therethrough linking said suction chamber to said further groove.

3. The compressor recited in claim 2, said at least one groove formed in an inner peripheral surface of said central bore.

4. The compressor recited in claim 2, said at least one grooved formed in an outer peripheral surface of said adjusting screw.

5. The compressor recited in claim 2 further comprising an annular shim disposed between said adjusting screw and the end of said drive shaft extending into said central bore.

6. The compressor recited in claim 2 further comprising an annular thrust bearing disposed between said adjusting screw and the end of said drive shaft extending into said central bore.

7. The compressor recited in claim 2 further comprising a bearing disposed in said front end plate, said bearing rotatably supporting said drive shaft within said front end plate.

8. The compressor recited in claim 2, said valve control means disposed in a further chamber formed in said cylinder block, said further chamber linked in fluid communication with said opposite end of said further groove and with said hole.

9. The compressor recited in claim 8, said valve control means comprising a bellows valve means for sensing the pressure of said crank chamber.

10. The compressor recited in claim 2, said valve control means disposed in said suction chamber.

11. The compressor recited in claim 10, said valve control means comprising a bellows valve means for sensing the pressure of said suction chamber.

12. The compressor recited in claim 10, said valve control means comprising an electromagnetic valve.

13. In a compressor including a compressor housing, said compressor housing including a cylinder block, a front end plate disposed on one end of said cylinder block, a rear end plate disposed on an opposite end of said cylinder block, said rear end plate having a discharge chamber and a suction chamber formed therein, said cylinder block having a plurality of cylinders formed therein, a crank chamber disposed forward of said plurality of cylinders and enclosed within said cylinder block by said front end plate, a piston slidably fitted within each of said cylinders and reciprocated by a drive mechanism, said drive mechanism including a drive shaft extending through an opening in said front end plate and rotatably supported therein, a drive rotor fixedly attached to and rotatable with said drive shaft, a slant plate attached to said drive rotor and disposed around said drive shaft, said slant plate having a surface disposed at an inclined angle with respect to a plane perpendicular to the longitudinal axis of said drive shaft, said inclined angle adjustable with respect to said plane, said slant plate linked to said pistons to reciprocate said pistons in said cylinders, said cylinder block further comprising a central bore having an axially positionable adjusting screw disposed therein, said adjusting screw dividing said central bore into a front chamber and a rear chamber, said drive shaft extending into said central bore, the axial position of said drive shaft adjustable by said adjusting screw, a communicating path linking said crank chamber to said suction chamber, a valve control means for controlling the opening and closing of said communicating path, the inclined angle of said slant plate changing in response to a change of pressure in said crank chamber, the change in pressure in said crank. chamber controlled by the opening and closing of said communicating path by said valve control means, the improvement comprising:

said communicating path including at least one groove formed within said central bore, and linking said front chamber of said central bore to said rear chamber of said central bore, said front chamber also linked to said crank chamber; and a further groove formed between a rearward surface of said cylinder block and said rear end plate, said further groove linked in fluid communication at one end with said rear chamber, said further groove linked in fluid communication at an opposite end with said suction chamber, said communicating path thereby linking said crank chamber to said suction chamber.

14. The compressor recited in claim 13 further comprising a valve plate disposed between said rear end plate and said cylinder block, said valve plate including a hole formed therethrough linking said suction chamber to said further groove.

15. The compressor recited in claim 14, said at least one groove formed in an inner peripheral surface of said central bore.

16. The compressor recited in claim 14, said at least one grooved formed in an outer peripheral surface of said adjusting screw.

17. The compressor recited in claim 14 further comprising an annular shim disposed between said adjusting screw and the end of said drive shaft extending into said central bore.

18. The compressor recited in claim 14 further comprising an annular thrust bearing disposed between said adjusting screw and the end of said drive shaft extending into said central bore.

19. The compressor recited in claim 14 further comprising a bearing disposed in said front end plate, said bearing rotatably supporting said drive shaft within said front end plate.

20. The compressor recited in claim 14, said valve control means disposed in a further chamber formed in said cylinder block, said further chamber linked in fluid communication with said opposite end of said further groove and with said hole.

21. The compressor recited in claim 20, said valve control means comprising a bellows valve means for sensing the pressure of said crank chamber.

22. The compressor recited in claim 14, said valve control means disposed in said suction chamber.

23. The compressor recited in claim 22, said valve control means comprising a bellows valve means for sensing the pressure of said suction chamber.

24. The compressor recited in claim 22, said valve control means comprising an electromagnetic valve.

* * * * *